US006077154A

United States Patent [19]

Takashi et al.

[11] Patent Number: 6,077,154

[45] Date of Patent: Jun. 20, 2000

[54] POLISHING APPARATUS FOR OPTICAL FIBER END SURFACE

[75] Inventors: Syuichi Takashi, Kamagaya; Takehiko Narita, Funabashi, both of Japan

[73] Assignee: Seikoh Giken Co., Ltd., Chiba-Ken, Japan

[21] Appl. No.: 08/972,950

[22] Filed: Nov. 19, 1997

[30] Foreign Application Priority Data

Jul. 14, 1997 [JP] Japan ..... 9-205409

[51] Int. Cl.[7] ..... B24B 7/00

[52] U.S. Cl. ..... 451/271; 451/384; 451/256; 451/278; 451/42

[58] Field of Search ..... 451/271, 42, 256, 451/278, 384, 389

[56] References Cited

U.S. PATENT DOCUMENTS

| | | | |
|---|---|---|---|
| 791,254 | 5/1905 | Day | 451/271 |
| 2,579,666 | 12/1951 | Hans | 451/271 |
| 2,686,391 | 8/1954 | Porter et al. | 451/42 |
| 3,435,569 | 4/1969 | Stanley | 451/271 |
| 4,106,240 | 8/1978 | De Bartolo | 451/42 |
| 4,831,784 | 5/1989 | Takahashi . | |
| 4,979,334 | 12/1990 | Takahashi | 451/271 |
| 5,140,660 | 8/1992 | Takahashi . | |
| 5,351,445 | 10/1994 | Takahashi | 451/271 |
| 5,547,418 | 8/1996 | Takahashi | 451/278 |
| 5,640,475 | 6/1997 | Takahashi | 451/271 |

*Primary Examiner*—David A. Scherbel
*Assistant Examiner*—Lee Wilson
*Attorney, Agent, or Firm*—Venable; Robert Kinberg

[57] ABSTRACT

The present invention provides a polishing apparatus for optical fiber end surface making it possible to freely adjust the contact pressure between a polishing plane and the distal end face of a ferrule and capable of preventing a defective product from being produced under polishing. A control circuit drives a vertically driving mechanism to allow a ferrule holding plate to move from a preparation state to a ferrule polishing starting state and by compressing a spring it then allows the ferrule holding plate to lower further beyond the starting state to complete the polishing.

15 Claims, 12 Drawing Sheets

POLISHING APPARATUS FOR OPTICAL FIBER END SURFACE

BACKGROUND OF THE INVENTION

1. Field of the Invention

The present invention relates to a polishing apparatus for optical fiber end surface for polishing the end surface of a ferrule used for an optical fiber connector of an optical-fiber communication circuit together with an optical fiber.

2. Description of the Related Art

To make an optical connection by physically contacting a ferrule with an optical fiber, it is preferable that a contact plane is polished into a flawless and spherical surface. Moreover, to improve the connection efficiency, it is desired that the physical spherical-surface contact keeps an angled physical contact (APC). In the case of an angled physical contact ferrule (APCF) requiring the slant spherical-surface polishing for performing polishing by slanting up to approx. 8° to 12° in relation to the optical axis of an optical fiber in order to decrease a return reflection loss, it is difficult to grind the ferrule end surface because the ferrule end surface is greatly removed due to polishing.

U.S. Pat. No. 4,831,784 discloses a polishing apparatus for optical fiber end surface for polishing the end surface of a ferrule together with an optical fiber by supporting a plurality of ferrules with optical fibers by one holder.

The present invention makes it possible to grind the distal ends of a ferrule and an optical fiber into a flawless surface by moving a holder in relation to a base along a small circle, that is, moving the distal end of the optical fiber along the small circle and rotating a polishing board in relation to the base and thereby, according to the relative movement between them.

In the case of U.S. Pat. No. 4,979,334, a plurality of optical fibers supported by a holder are spherically polished together with a ferrule by moving the center of a polishing board along a circle and rotating the board in relation to a base. The distal ends of the ferrule and the optical fiber are polished into a flawless surface.

U.S. Pat. No. 5,140,660 discloses a ferrule polishing apparatus and the polishing method. The ferrules are available for an angled physical contact (APC). In the apparatus, a polishing film is placed on an elastic pad on a polishing board.

The apparatuses disclosed in U.S. Pat. No. 4,831,784 and U.S. Pat. No. 4,979,334 realize considerably preferable polishing. However, fluctuation in qualities due to an inclination of a holder may occur between ferrules.

Therefore, to solve the above problem, U.S. Pat. No. 5,351,445 uses a linearly-guiding mechanism vertically moving on the outer circumference of the holder in parallel with a base so that the holder does not incline in the relative movement for polishing between the polishing board and the holder in U.S. Pat. No. 4,979,334.

SUMMARY OF THE INVENTION

Fluctuation in polishing qualities due to an inclination of a holder is solved by using a linearly guiding mechanism for vertically moving on the outer circumference of the ferrule holder in parallel with a base in U.S. Pat. No. 5,351,445.

A problem with prior art devices occurs at the start of polishing due to variations in the length of optical fiber protruding from the distal end of a ferrule and the amount of adhesive around the distal end. The problem is further stated below by referring to FIGS. 14 and 15.

FIG. 14 is an illustration showing a ferrule and an optical fiber to be polished. The distance L between the distal end of the bonded ferrule and the distal end of the adhesive frequently fluctuates in general. In the process for polishing the distal end of PC coupling of the optical fiber, the adhesive and the protruded portion of the optical fiber are first polished and removed and then, the distal end of the ferrule 123 and the distal end of the optical fiber 123*b* are polished into a spherical surface and finally polished for finishing.

The problems described below occur when polishing objects with different distances L between the distal end of the ferrule and the distal end of the adhesive at the same time by using the embodiment apparatus (FIG. 15) in U.S. Pat. No. 5,351,445. In the case of this conventional apparatus, a male screw cylinder 127 for adjusting the final height between a holder 121 for supporting a plurality of ferrules and a polishing pad 117 is provided integrally for a polishing apparatus base 114. A shaft supporting cylinder 126 for guiding is screwed to the male screw cylinder 127 to determine the shaft supporting cylinder 126 for guiding for the polishing apparatus base 114. A plurality of shafts 110 for guiding are vertically implanted to the shaft supporting cylinder 126 for guiding. A plurality of holes 121*a* corresponding to the shafts 110 for guiding are formed on the holder 121 and the holder 121 is supported so as to be vertically movable along the shafts 110 for guiding without inclining. A rotary disk 115 is rotated about the polishing apparatus base 114 (rotation) while the center of the disk 115 moves on a circle (revolution). In the case of the ferrules with the optical fibers 123 bonded with an optical fiber described in FIG. 13, the distal end inserted into the hole of the holder 121 is protruded in the direction of the polishing pad 117 and secured by a nut 125.

As shown in FIG. 15, a case is assumed in which the adhesive of the optical fiber ferrule supported by the holder 121 at the left in FIG. 15 has a large protrusion length L. The holer 121 is urged downward by a weight 111 connected to a weight shaft 112 at the center. Therefore, the entire urging force is concentrated on the distal end of the left ferrule, an abnormal force is applied at start of polishing, and the distal end of the optical fiber may be broken. Even if all ferrules uniformly contact the polishing pad, in the initial process a large force is applied to the distal end of the optical fiber which may result in cracking or distortion of the fiber. Moreover, as described above, to grind the PC end of the optical fiber ferrule, it is necessary to change the films arranged on a polishing plane. In this case, it is necessary to temporarily remove the holder 121. However, because the holder 121 has a considerably large weight, it burdens an operator.

It is a main object of the present invention to provide the above-described polishing apparatus for optical fiber ferrule end surface making it possible to freely adjust the contact pressure between a polishing plane and the distal end surface of a ferrule and prevent the above-described defective products from being produced in polishing.

It is an another object of the present invention to provide a polishing apparatus for optical fiber end surface making it possible to optionally adjust the height of a ferrule holder by improving ferrule holder supporting means for supporting an optical fiber ferrule for polishing and easily replace a polishing plane by increasing the rising distance to decrease the burden of an operator.

It is still an another object of the present invention to provide a polishing apparatus for optical fiber end surface making it possible to easily set or remove a ferrule holder by improving ferrule holder supporting means for supporting an optical-fiber ferrule for polishing to decease the burden of an operator.

To achieve the above objects, a polishing apparatus for optical fiber end surface of the present invention is constituted by comprising:

a base;

a rotary disk supporting a polishing member for forming a polishing plane and rotatably set to the base;

ferrule holding means for removably supporting one or more optical-fiber ferrule;

vertically guiding means for vertically movably supporting the ferrule holding means in parallel with the polishing plane and moving between a reference position and a polishing end position;

urging means for urging the vertically guiding means supporting the ferrule holding means in the direction vertical to the polishing plane;

vertically driving means for vertically driving the vertically guiding means supporting the ferrule holding means; and a control circuit for driving the vertically driving means.

The urging means can comprise first urging means for urging the vertically guiding means supporting the ferrule holding means in the direction of the polishing plane and second urging means for urging the vertically guiding means in the direction separating from the polishing plane.

The second urging means can use a spring for urging the vertically moving means upward while it lowers in order to make the weights of the vertically moving means and the ferrule holding means under lowering apparently approach to zero.

The first urging means can be constituted so as to provide the contact pressure between a ferrule and the polishing plane under polishing.

The first urging means is a compression spring capable of changing the contact pressure between a ferrule and the polishing plane under polishing by adjusting the compression length.

The vertically guiding means can be constituted so as to include a vertically moving plate secured to a plurality of supports slidably guided by a plurality of bearings vertical to the polishing plane in the axial direction.

The vertically driving means can be constituted so as to include linearly driving means for vertically driving the vertically moving means.

The ferrule holding means can be constituted so as to include removable means for removably supporting the ferrule holding means to the vertically moving means.

The removable means can be constituted so as to slide by fitting to the parallel groove portion of the ferrule holding means at the aperture provided for the vertically moving plate of the vertically moving means like a U shape.

The removable means can be constituted so as to bayonet-connect the ferrule holding means to a bayonet aperture provided for the vertically moving plate of the vertically moving means.

It is possible to use spring press-fitting means for press-fitting the ferrule holding means with the vertically moving means on the reference plane of mutual height.

It is possible to use securing means for engaging the ferrule holding means with the vertically moving means and then securing the ferrule holding means to the vertically moving means.

A control circuit can control the lowering speed of the vertically moving means and moreover can decrease the lowering speed under polishing immediately before the ferrule contacts the polishing plane.

The control circuit can be constituted so as to set a polishing time in accordance with the polishing purpose.

It is possible to previously set a plurality of combinations between a polishing time and a contact pressure and control the combinations in one repetition of rising and lowering.

DESCRIPTION OF THE PREFERRED EMBODIMENTS

Polishing apparatuses for optical fiber of the present invention are described below by referring to the accompanying drawings.

Figure 1:
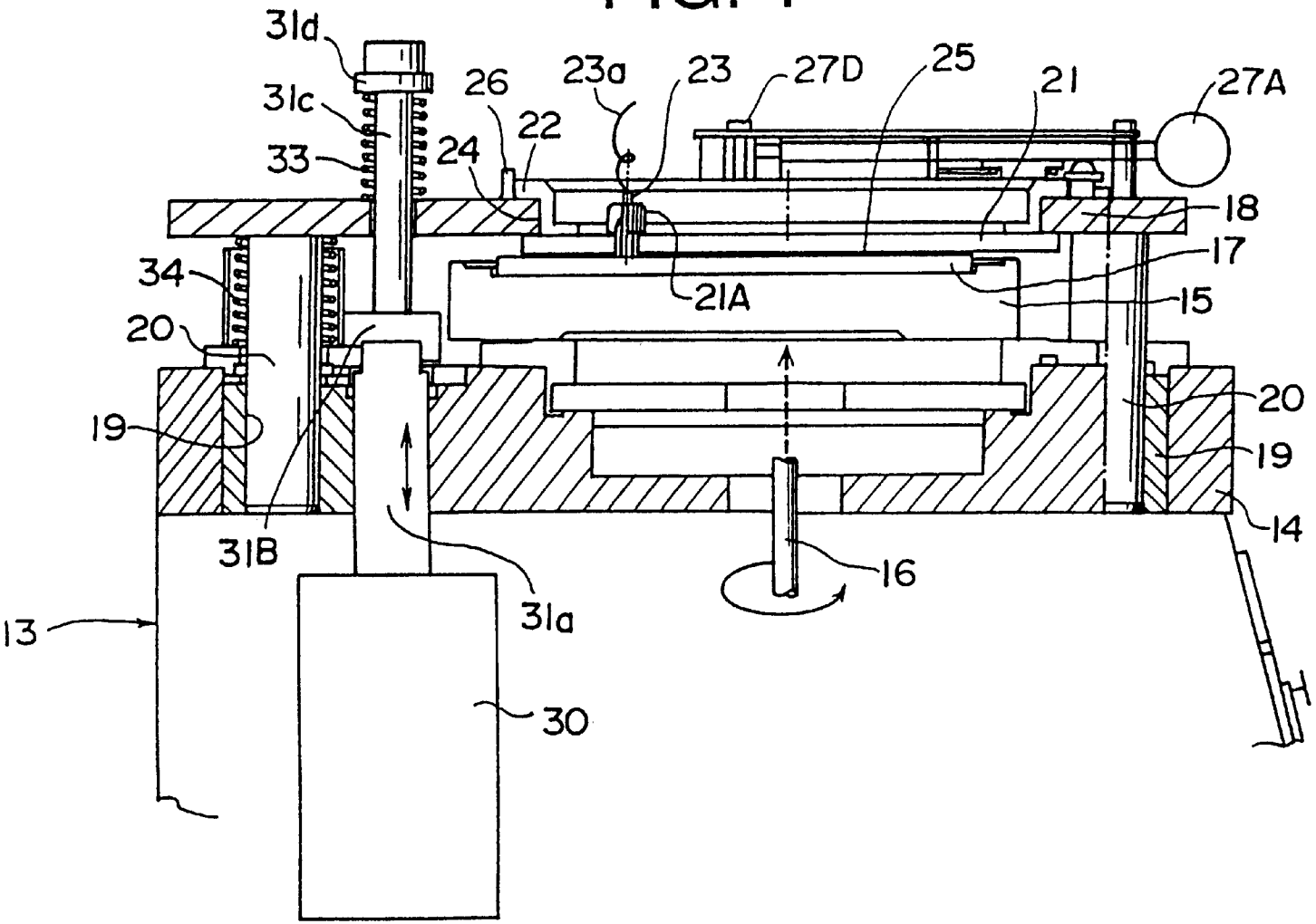
FIG. 1 is a side view of a first embodiment of a polishing apparatus for optical fiber of the present invention.
Figure 2:
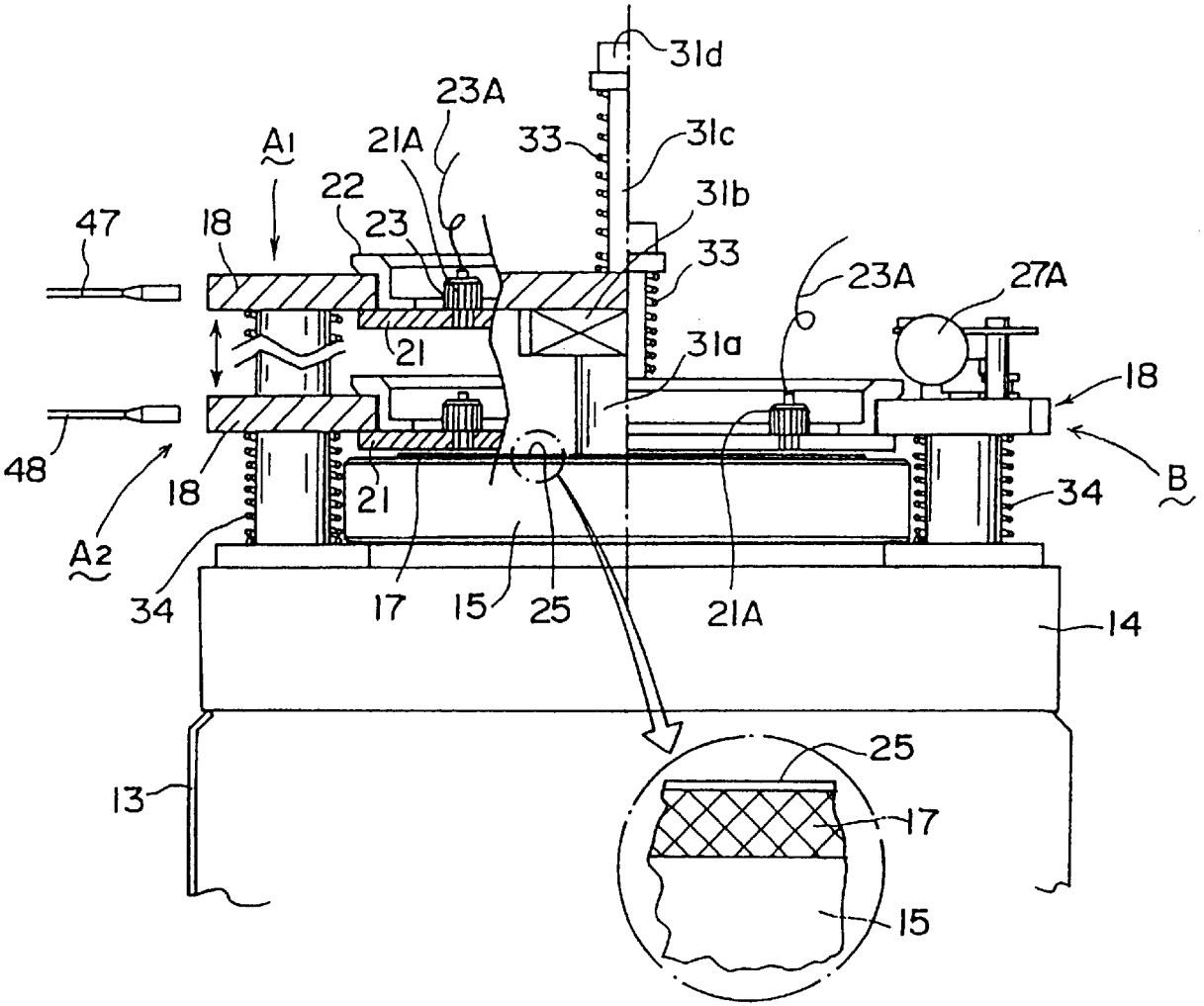
FIG. 2 is a front view of the embodiment in FIG. 1.
Figure 3:
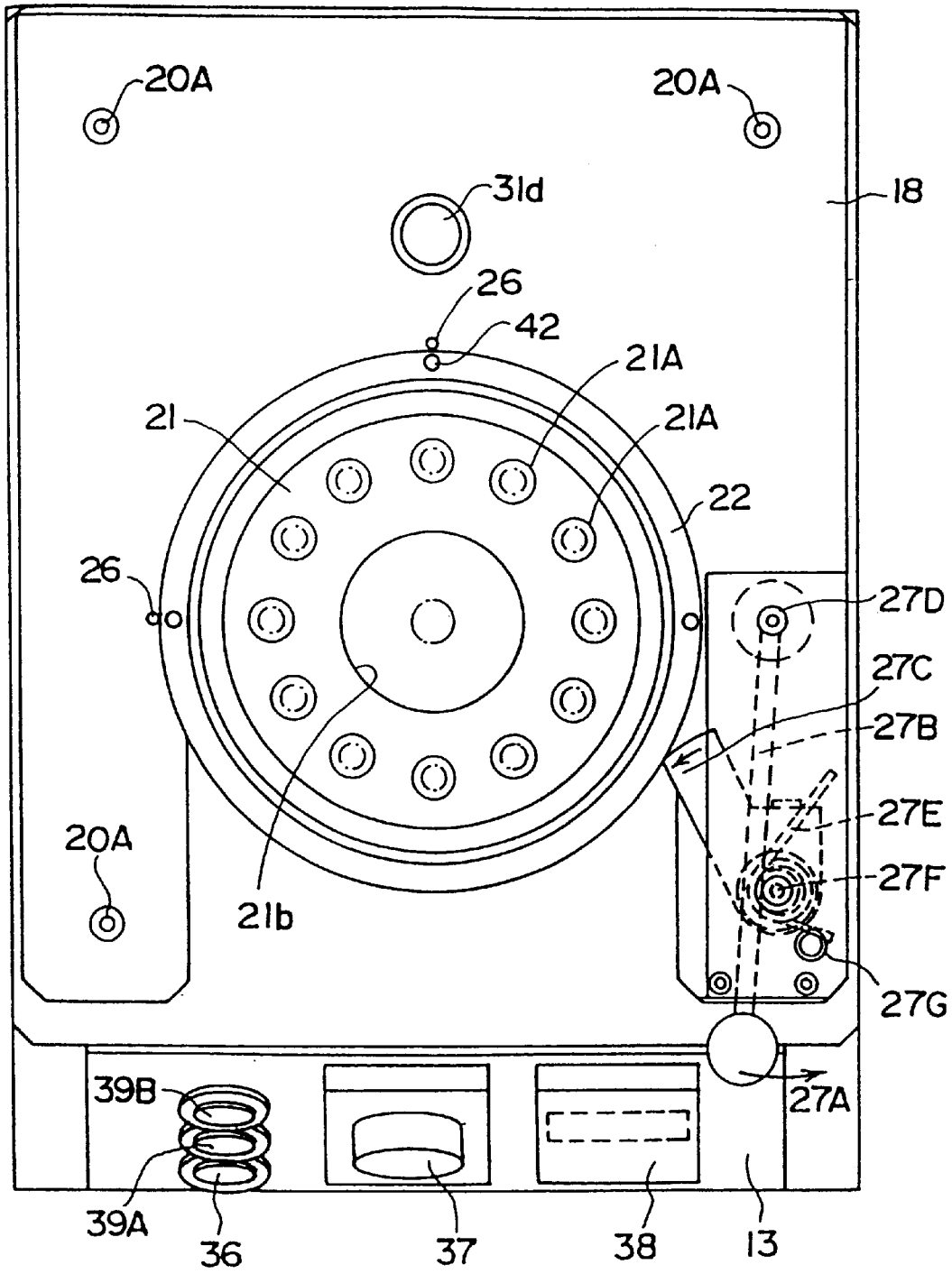
FIG. 3 is a top view of the embodiment in FIG. 1.
Figure 4:
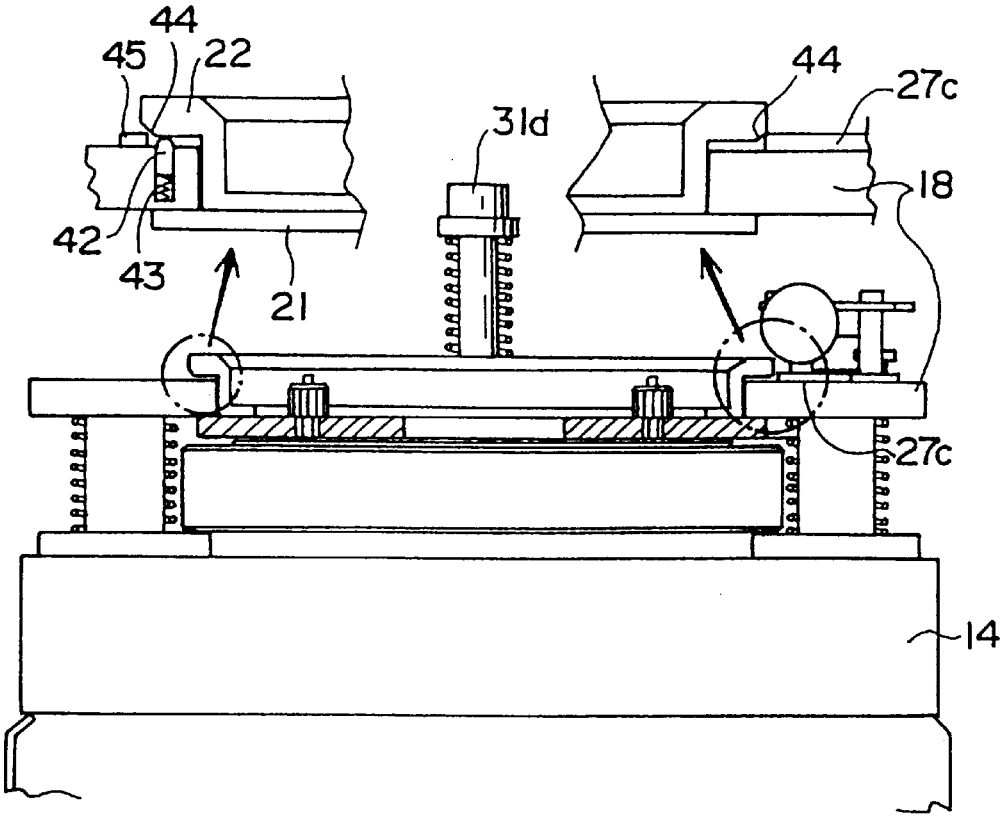
FIG. 4 is a locally-enlarged front sectional view of the locking means of the ferrule holding means of the embodiment in FIG. 1.

FIGS. 1 to 5 are illustrations showing a first embodiment of a polishing apparatus for optical fiber end surface of the present invention, in which FIG. 1 is a local sectional view of the lateral of the embodiment, FIG. 2 is a local sectional view of the front of the embodiment, FIG. 3 is a top view of the embodiment, and FIG. 4 shows an locally enlarged view of the securing portion in a front view of the embodiment.

A rotary disk 15 is mounted on a polishing-apparatus base 14. The rotary disk 15 is rotated and revolved by not-illustrated rotation and revolution mechanisms in relation to the polishing-apparatus base 14 because rotation of a not-illustrated motor is transmitted through a rotary disk driving shaft 16. A polishing film 25 is put on the surface of the rotary disk 15 through a pad 17. FIG. 2 shows these relations by locally enlarging them. The pad 17 selectively uses a glass plate or an elastic pad in accordance with the purpose. The polishing film 25 is coated with an abrasive for polishing the end surface of an optical fiber. The driving mechanism of the rotary disk 15 can use a generally-known mechanism such as the rotational-revolutionary motion mechanism disclosed in, for example, U.S. Pat. No. 4,979,334. Moreover, it is possible to use a rotary disk for mere rotational motion.

A linearly guiding bearing 19 is provided for four corners of the base 14 and a guiding shaft 20 is inserted into each corner. A vertically moving plate 18 vertically moving by removably supporting ferrule holding means is secured to the top of each guiding shaft 20 by a screw 20A.

The vertically moving plate 18 is constituted so that the plate 18 can vertically move in parallel with the rotary disk 15 while supporting the ferrule holding means.

The ferrule holding means comprises a collar 22 of the upper ferrule holding means and a flat ferrule-holder plate 21 formed integrally with the collar 22.

The gap between the bottom of the collar 22 of the ferrule holding means and the top of the ferrule holder plate 21 is slightly larger than the thickness of the vertically moving plate 18 and a groove 24 is formed on the gap. The vertically moving plate 18 has a semicircularly-pointed U-shaped receiving hole at its center and the ferrule holding means is inserted from the open end (front) of the hole.

The ferrule holder plate 21 of the ferrule holding means is constituted so as to support one or more ferrule 23 to be polished, twelve ferrules 23 in the case of this embodiment, by turning the distal ends of them downward, holes into which distal ends of ferrules are inserted are formed on the ferrule holder plate 21, and the ferrules inserted into the holes are fastened and secured by a box nut 21A. An aperture 21*b* is formed at the center of the ferrule holder plate 21, through which a polishing plane can be observed.

A positioning pin 26 for designating a position when the ferrule holding means is inserted (see FIGS. 1 and 3) is implanted at two places on the vertically moving plate 18, which contacts the outer circumference of the collar 22 of the ferrule holding means to determine the position. Means for securing the ferrule holding means is provided for the right front of the vertically moving plate 18. A locking pawl 27C of the securing means is urged by a spring 27E in the counterclockwise direction about a spring shaft 27F. The locking pawl 27C is retreated in the clockwise direction by operating a knob 27A of a lever 27B pivoted by a shaft 27D. A coil spring 27E of the securing means urges the locking pawl 27C in the counterclockwise direction (see FIG. 3) and secures the ferrule holding means to the position in FIG. 3. The right enlarged sectional view in FIG. 4 shows a state in which the locking pawl 27C is brought into contact with and secured by a chamfered portion 44 under the collar 22 of the ferrule holding means.

The left enlarged sectional view in FIG. 4 shows a state in which a securing pin 45 is brought into contact with the chamfered portion 44 under the collar 22 of the ferrule holding means and the bottom of the collar 22 of the ferrule holding means is forcibly pushed up by a ball plunger 42 provided for the hole at the vertically moving plate 18. The ball plunger 42 is pushed up by a spring 43. Thus, the ferrule holding means and the vertically moving means are press-fitted each other on the reference plane of mutual height and the bottom of the vertically moving plate 18 and the top of the ferrule holder plate 21 are press-fitted each other.

FIG. 2 is a front view of the first embodiment, showing three states of the ferrule holder plate 21 connected to the vertically moving plate 18. The state shown by $A_1$ at the left in FIG. 2 shows a preparation state in which the vertically moving plate 18 is raised. At this position, the ferrule holding means is set or removed or the polishing plane is replaced. The state shown by $A_2$ at the left in FIG. 2 shows a state in which the vertically moving plate 18 lowers to start polishing. The state shown by B at the right in FIG. 2 shows a state in which the vertically moving plate 18 further lowers to perform polishing.

A vertically driving motor 30 (see FIG. 1) is provided for a frame 13 under the polishing-apparatus base 14 and the shaft 31*a* is linearly advanced or retreated by an internal gear mechanism.

The shaft 31*a* operates vertically to the base 14 and has a collar 31*b* for raising the vertically moving plate 18 at its distal end. A shaft 31*c* passing through the vertically moving plate 18 and extending upward is integrally provided for the top of the collar 31*b*. A head 31*d* is provided for the distal end of the shaft 31*c* and a coil spring 33 having a free length equal to the length between the head and the vertically moving plate 18 is set between the head and the plate 18 so that a downward force can be provided for the vertically moving plate in accordance with lowering of the head 31*d*. A coil spring 34 is set to the outer circumference of a guide shaft 20 between the vertically moving plate 18 and the base 14. Though this spring can be set to every spindle, it is set to two rear spindles in the case of this embodiment.

Figure 5:
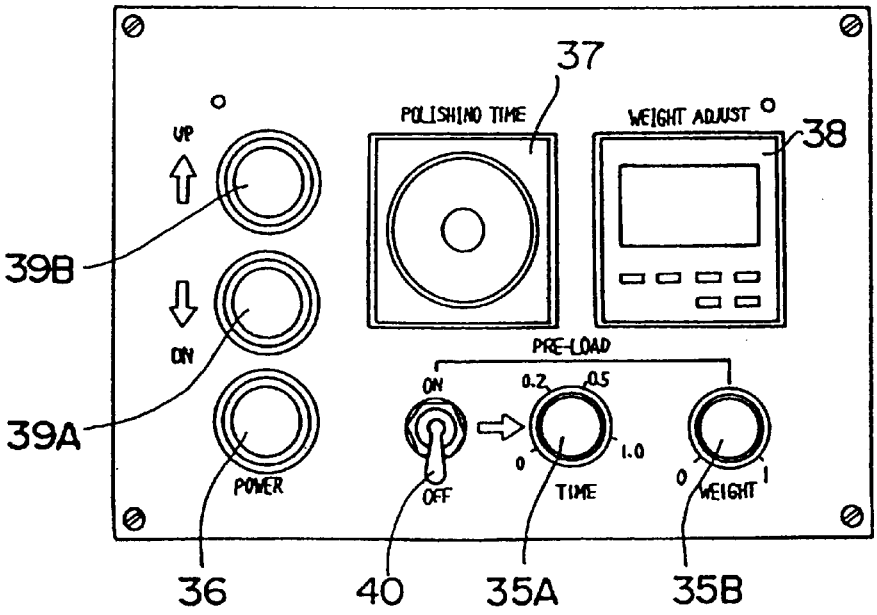
FIG. 5 is a front view showing the operation panel of the embodiment in FIG. 1.

A counter, a relay, a motor for driving the rotary disk 15, and a sequence circuit (not illustrated) using a timer are built in the frame 13 in addition to the above vertically driving motor 30 in order to control vertical movement. FIG. 5 shows an operation panel of the sequence circuit provided for the front of the frame 13. Position sensors 47 and 48 shown in FIG. 2 are sensors for detecting the position of the vertically moving plate 18 and they are connected to the sequence circuit to provide control signals.

FIG. 5 is an operation panel for inputting polishing conditions. A switch 36 serves as a power switch of the apparatus.

A time of a preliminary process for removing the adhesive from the distal end of a ferrule is set by an adhesive-removing-time setting dial 35A. A pressure in the preliminary process is set by an adhesive-removing-pressure setting dial 35B. The pressure is set by driving the motor 30 to determine the position of a shaft 31 and adjusting the compressive force of a spring 33. A dial 37 is a dial for setting a polishing time for polishing a ferrule (main process) and it is set to 3 kg weight in the case of the following embodiment. A dial 38 is a dial for setting a pressure for ferrule polishing (main process). Buttons 39A and 39B are buttons for selecting the moving direction, or the rising and lowering of a vertically moving plate respectively. A switch 40 is a selection switch for selecting whether to perform the preliminary process or not.

Polishing operations of the apparatus having the above structure are briefly described below. Lowering of the vertically moving plate 18 is started from the standby state shown by $A_1$ in FIG. 2 by driving the vertically driving motor 30. While the vertically moving plate 18 is lowered, the coil spring 34 between the vertically moving plate 18 and the base 14 is depressed by the vertically moving plate 18.

When a sequencer detects the point of time when an adhesive attached portion 123*c* (see FIG. 14) of the ferrule 23 to be polished integrated with the vertically moving plate 18 reaches a predetermined position (0.5 to 1 mm) where the portion 123*c* contacts the polishing film 25, the sequencer changes the lowering speed to a low speed and simultaneously starts driving the rotary disk 15.

The length of the depression spring 33 between the head 31*d* of the shaft 31*c* and the vertically moving plate 18 is kept at its free length. While the vertically moving plate 18 is brought into contact with and integrated with the vertically moving collar 31*b*, the length of the depression spring 33 is kept at its free length. Pressuring of a ferrule to be polished (polishing pressure) is performed by the coil spring 33. The pressure can be changed by changing the compression length of the coil spring 33 from the free length.

Lowering of the vertically moving plate 18 is stopped from the point of time when the distal end of the ferrule with the optical fiber 23 integrated with the vertically moving plate is pressed against the polishing plane of the rotary disk 15 in FIG. 4. Meantime, the driving shaft 31*a*, collar 31*b*, and spring compression shaft 31*c* continuously lower together, the coil spring 33 is compressed by the head 31*d* of the spring compression shaft, and the ferrule with the optical fiber 23 integrated with the vertically moving plate 18 is pressured. Because the lowering distance is proportional to the compression length of the coil spring 33, the number of pulses generated due to movement of the driving shaft is counted from the point of time when the sensor 35A operates and when the number of pulses reaches a preset value, driving is stopped.

By preparing a plurality of counters and a plurality of timers, it is possible to simultaneously perform a plurality of processes. This sequence is realized by generally known means and the description is omitted. A polishing time is set by a timer 37. In the case of end of polishing, the rotary disk 15 is stopped by a stop instruction by the timer after a predetermined time passes. Then, rising of the vertically driving shaft 31 is started and the vertically moving plate 18 and the ferrule holding means integrated with the plate 18 are pushed up by the collar 31*b* of the vertically driving shaft 31. When the plate 18 and the ferrule holding means reach the left standby position $A_2$ in FIG. 2, a position sensor 47 generates a detection output to stop driving.

An example of standard polishing using a polishing apparatus of the present invention is described below. Table 1 summarizes the combination between a polishing film and a pad and other data in each polishing process.

TABLE 1

Standard Zirconia Ferrule PC Polishing Conditions

| process | polishing film | pad (hardness) | time (min.) | load (kg weight) |
|---|---|---|---|---|
| 1 adhesive removal | GA5D | glass | 0.5 | 3 |
| 2 height alignment | GA5D | glass | 0.5 | 3 |
| 3 spherical surface formation | GA5D | synthetic resin (H70°) | 0.5 | 6 |
| 4 primary polishing | DR5D | synthetic resin (H70°) | 1.0 | 6 |
| 5 secondary polishing | DM5D | synthetic resin (H70°) | 0.5 | 6 |
| 6 finish polishing | SF5D | synthetic resin (H70°) | 0.5 | 6 |

Figure 6:
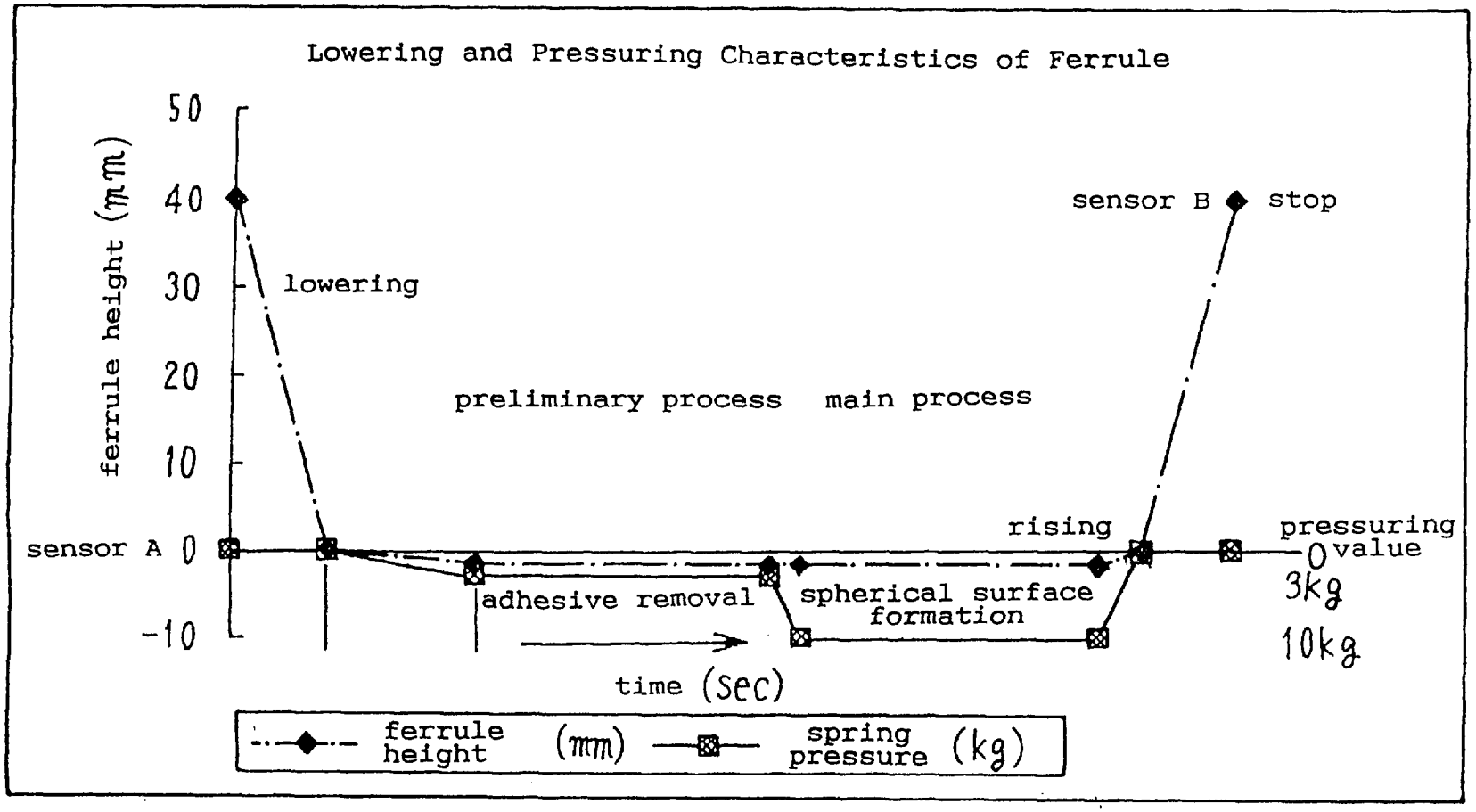
FIG. 6 is a graph for explaining the driving characteristics of the polishing apparatus in FIG. 1.

FIG. 6 is a graph showing the relation between motion and load of a ferrule in the above polishing. Y axis shows the height of the ferrule and the pressure between the ferrule and the polishing plane. X axis shows the operating time.

Operations are started by pressing a push button 39A (FIG. 5).

A sensor operates at the position where the ferrule lowers from the prepared position height 40 mm up to 0 mm, the lowering speed decreases to approx. 1/10, a spring load of 3 kg (polishing pressure) is reached for approx. 2.5 sec, and the adhesive and glass fiber are slowly cut and removed in the period of approx. 2.5 sec.

Then, after a predetermined time passes, lowering of the vertically driving shaft is started and the load reaches 6 kg and at this point of time, the height alignment process starts.

Of course, the height of the ferrule does not change. (Strictly saying, the height very slightly changes depending on the hardness of a polishing board). After the timer completes its operation, the vertically driving shaft starts rising and returns to the preparation position.

In this case, the polishing board and polishing film are replaced and the bottom of the ferrule holder is cleaned without taking out the ferrule holder, and the preparation state is set again.

Because of a simple process hereafter, it is only necessary to turn off the switch 40, disable the preparation process, and set the main process.

Setting of Conditions

The adhesive removal which is the first process is assumed as the preliminary process and the height alignment which is the second process is assumed as the main process and the both processes are simultaneously executed because the both processes use the same polishing film and polishing board (pad). Preliminary-process time setting is performed by setting the dial 35A in PRE-LOAD on the operation panel to 0.5 (min). Load setting is performed by setting the WEIGHT dial 36B in PRE-LOAD to 3 (kg).

Main-process time setting is performed by setting the timer 37 to 0.5 (min) and load setting is performed by setting the counter 38 to 6 (kg). An indication of the counter 38 is converted into the number of pulses of a motor-vertical-movement driving motor calculated from the spring constant of a coil spring B and controlled.

Moreover, it is possible to simultaneously control the counter 38 of the main process by the load setting dial 38 in the preliminary process. Furthermore, it is also possible to control the timer by keeping the lowering speed of the vertically driving shaft 30 constant and replacing the lowering distance which corresponds to the pressuring value with time.

Figure 7:
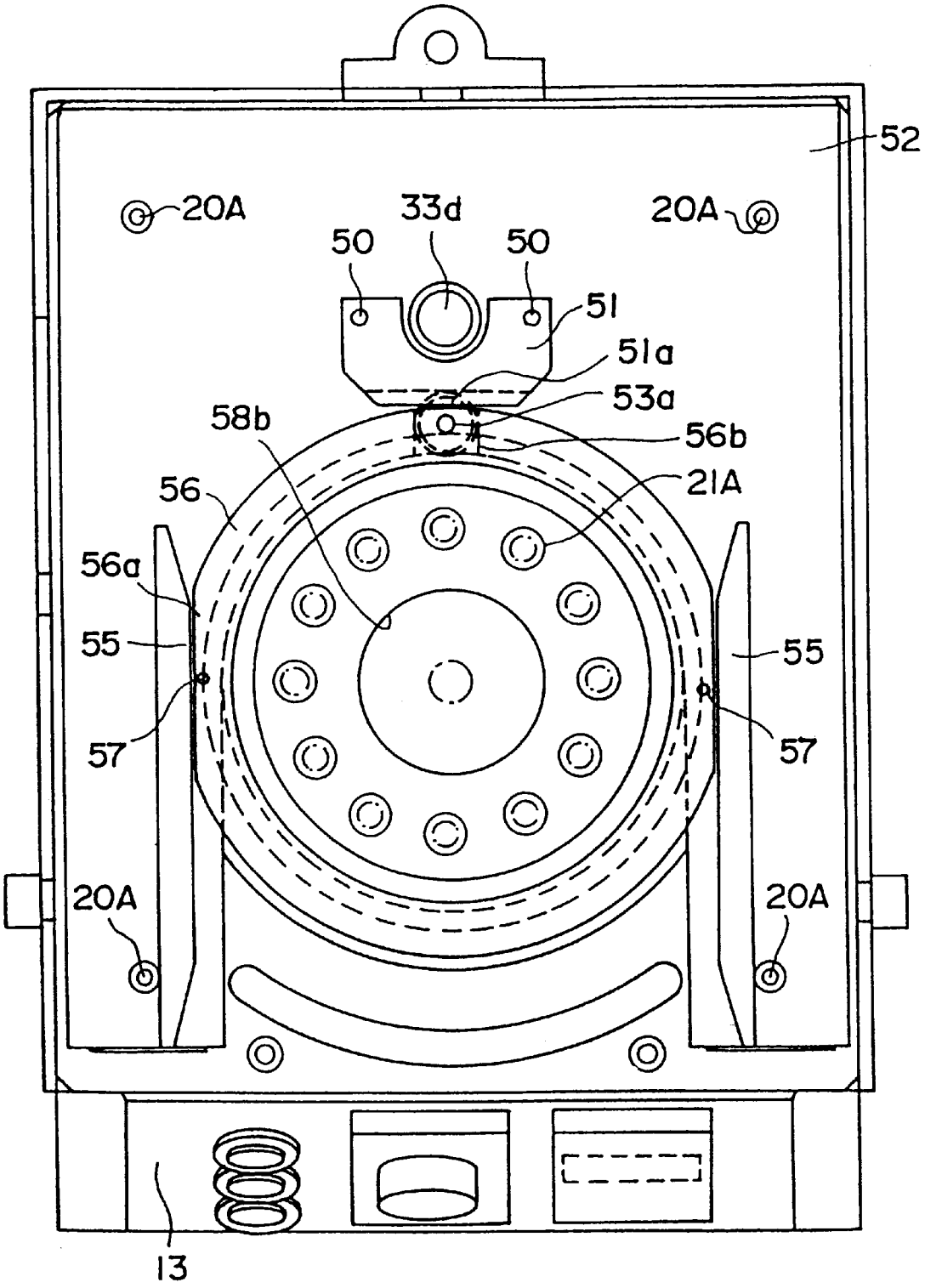
FIG. 7 is a top view of a second embodiment of a polishing apparatus for optical fiber of the present invention.
Figure 8:
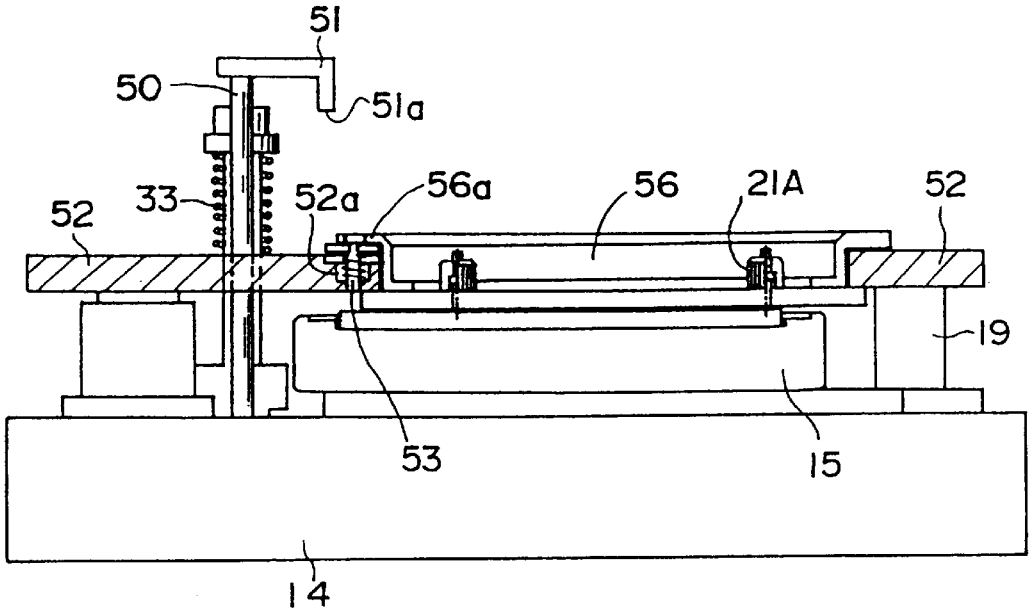
FIG. 8 is a side view showing a polishing state of the second embodiment in FIG. 7.
Figure 9:
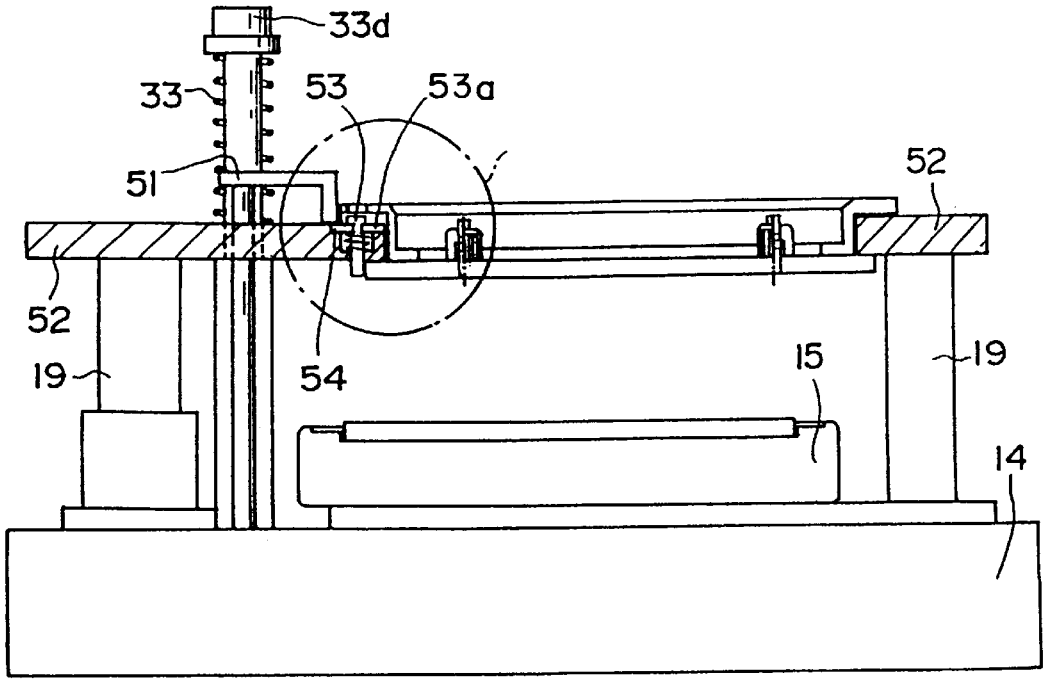
FIG. 9 is a side view showing a preparation state of the second embodiment in FIG. 7.
Figure 10:
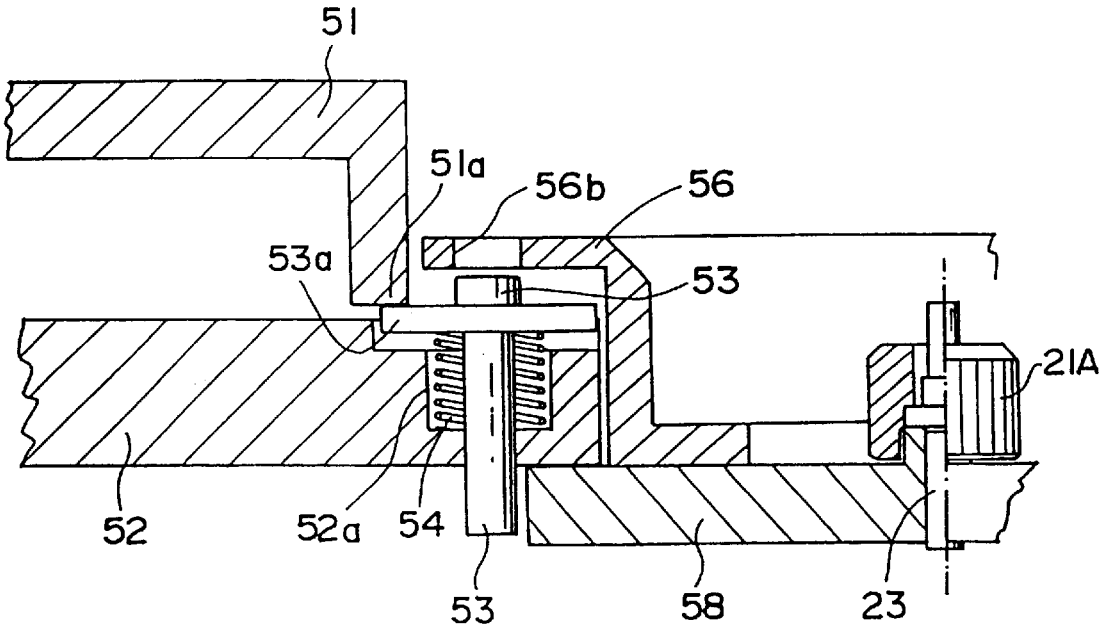
FIG. 10 is a locally-enlarged sectional view showing a part of FIG. 9 by enlarging it.
Figure 11:
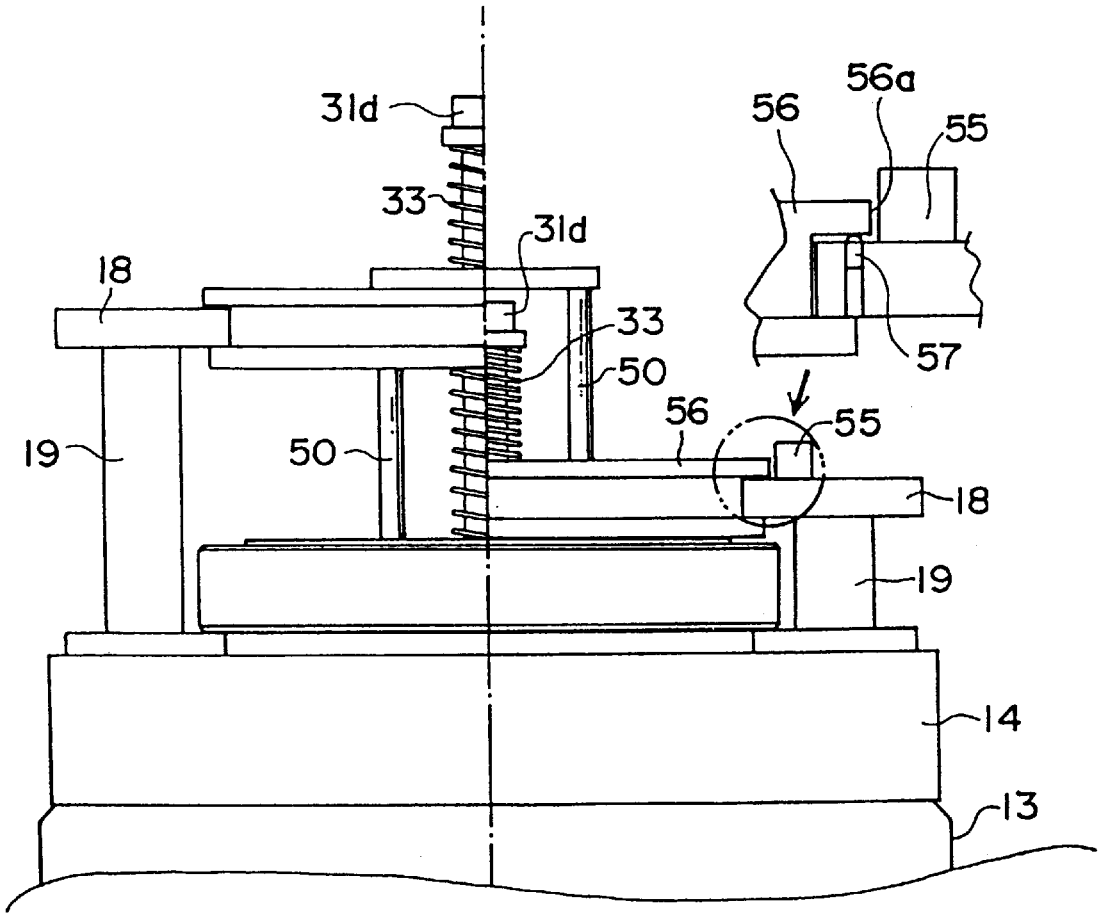
FIG. 11 is a front view of the second embodiment in FIG. 7.

FIGS. 7 to 11 are illustrations for explaining a second embodiment of a polishing apparatus for an optical fiber end surface of the present invention, in which FIG. 7 is a top view and FIG. 8 is a side sectional view showing the polishing state of the embodiment. FIG. 9 is a side sectional view showing the preparation state of the apparatus, FIG. 10 is a locally-enlarged side sectional view, and FIG. 11 is a front sectional view.

The basic structure of this embodiment is the same as that of the first embodiment except the structure of removable means for removably supporting ferrule holding means to the vertically moving means. Therefore, the structure of the removable means is mainly described below. Pushing-plate supporting rods 50 and 50 are provided for a vertically moving plate 52 having the same structure as the vertically moving plate 18 of the first embodiment and a push plate 51 is provided for distal ends of the pushing-plate supporting rods 50 and 50. The distal end 51*a* of the push plate 51 is curved in the direction of the vertically moving plate. A pin 53 is supported on a pin catching hole 53*a* of the vertically moving plate so that the collar 53*a* of a pin 52 is pushed up by a pin push spring 54. Ferrule holding means comprises a collar 56 and a ferrule mounting plate 58 and the collar 56 is provided with parallel cut portions 56*a* and 56*a* of the ferrule holding means correspondingly to a pair of rails 55 and 55 provided on the vertically moving plate 52. Moreover, the collar 56 of the ferrule holding means is provided with a pin head hole 56*b*. The vertically moving plate 52 is provided with a pair of ball plungers 57 (see FIG. 7).

By loading holder supporting means 56 and 58 along the rails 55 and 55 when the vertically moving plate 52 is present at the preparation position in FIG. 9, the pin hole 56*b* becomes coaxial with the pin 53.

Referring now to FIG. 10, when the vertically moving plate 52 starts lowering, the distal end of the push plate 51 relatively rises, the pin is inserted into the pin hole by the raising force of the coil spring 54, and the holder is secured at the front and the rear.

At the same time, the top of the holder supporting plate 58 for pushing up the holder supporting means and the bottom of the vertically moving plate 52 closely contact the collar 53*a* of the pin.

Referring now to FIG. 11 in the enlarged sectional view, the ball plungers 57 and 57 at two places are secured to the upper portion at three places in order to similarly push up the collar 56 of the holder supporting means. It is possible to remove the ferrule holding means by reversing the above procedure after rising.

Figure 12:
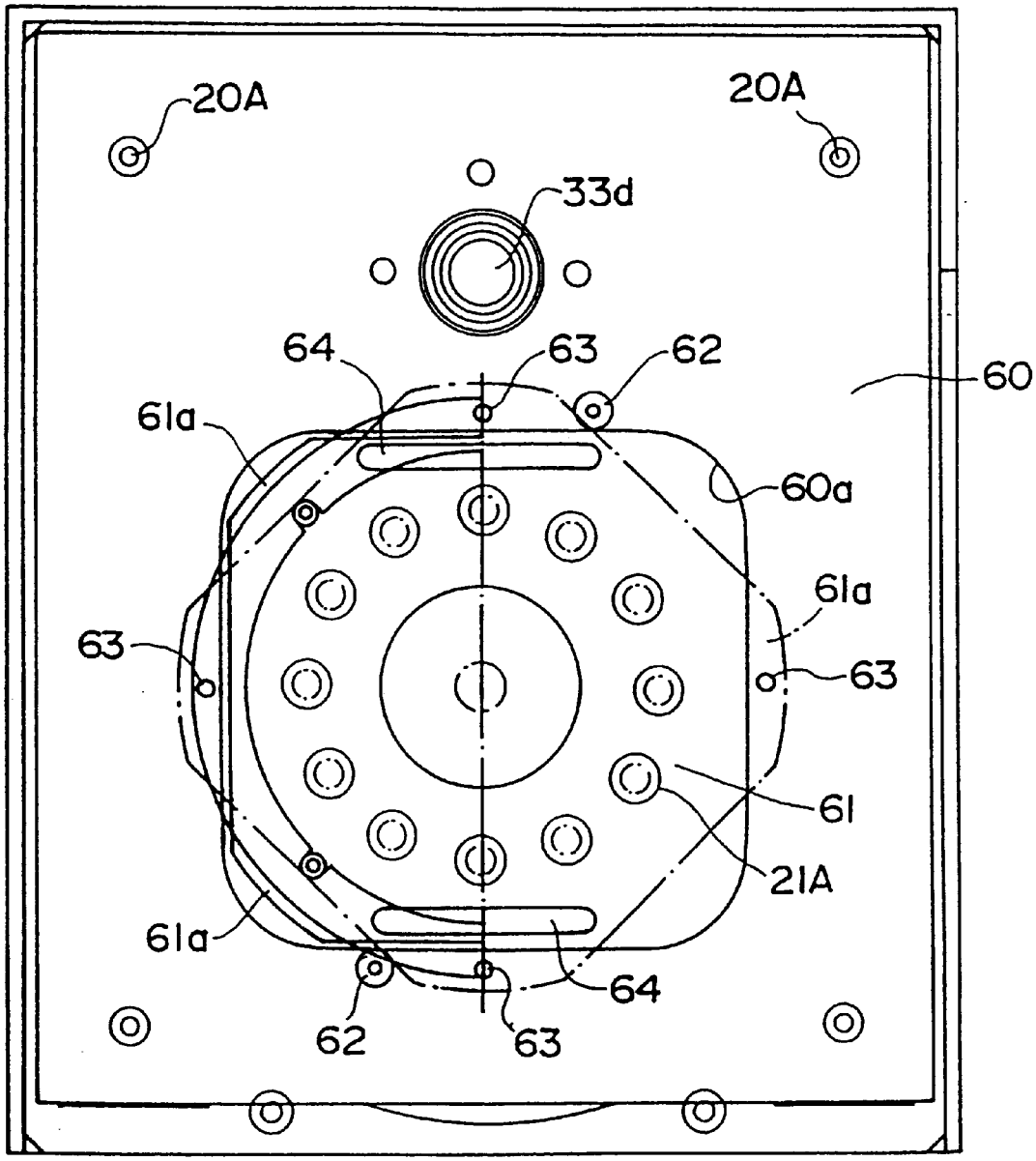
FIG. 12 is a top view of a third embodiment of a polishing apparatus for optical fiber end surface of the present invention.
Figure 13:
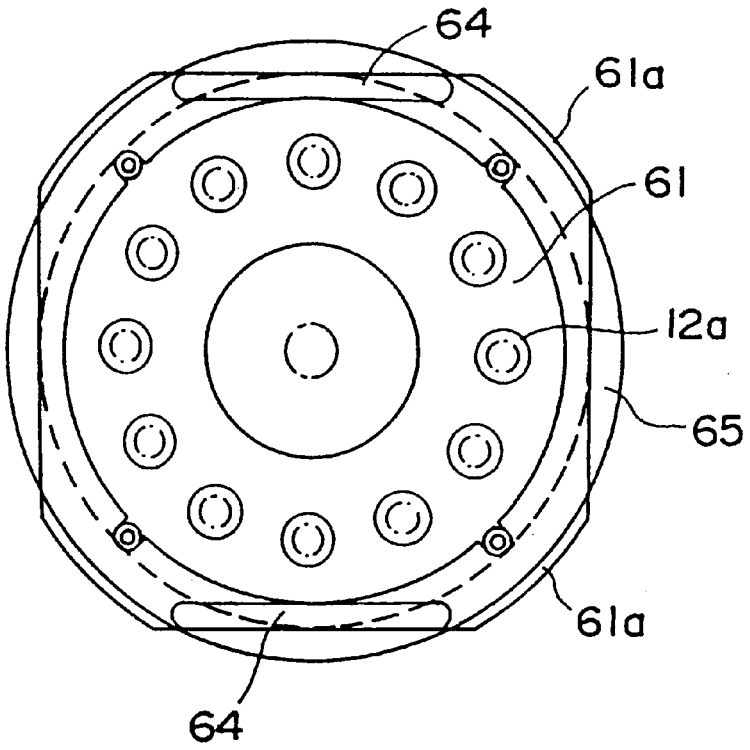
FIG. 13 is a top view showing ferrule means of the third embodiment in FIG. 12.

FIGS. 12 and 13 are illustrations showing a third embodiment of a polishing apparatus for optical fiber end surface of the present invention. The basic structure of this embodiment is the same as that of the second embodiment except the structure of removable means for removably supporting ferrule holding means to the vertically moving means. The above two embodiments have a structure in which a U-shaped aperture is formed on a vertically moving plate and ferrule holding means is secured by sliding and connecting it. However, this embodiment has a structure in which ferrule holding means is connected to a bayonet aperture provided for a vertically moving plate.

FIG. 12 shows a top view of the third embodiment and FIG. 13 shows ferrule holding means at an angular position before connection. An almost-quadrangular mounting hole 60*a* is formed on a vertically moving plate 60 of each embodiment above described. Four bayonet pawl portions 61*a* are formed on the holding plate 61 of the ferrule holding means. The collar 65 of the ferrule holding means is provided with U-shaped handles 64 and 64. The ball plunger 63 described above is set to four places of the vertical moving plate 60.

By holding the ferrule holding means 61 and 65 by the handle 64 at the angle shown in FIG. 13 to insert the means 62 and 65 into the apertures 60*a* of the vertical moving plate 60 and rotating them up to 45° clockwise, they are set to the positions shown by broken lines in FIG. 12. In this case, the bottom of the vertical moving plate 60 and the top of the ferrule holding means 61*a* are made to closely contact each other by being boosted by the ball plungers 63 at four places.

Because a polishing apparatus for optical fiber end surface of the present invention is constituted as described above, it has the following features.

Figure 14:
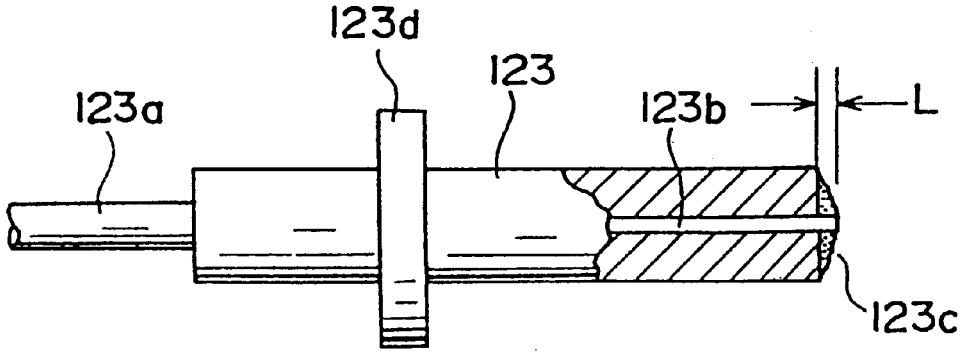
FIG. 14 is an illustration showing a ferrule with an optical fiber to be polished by cutting out a part of the ferrule.
Figure 15:
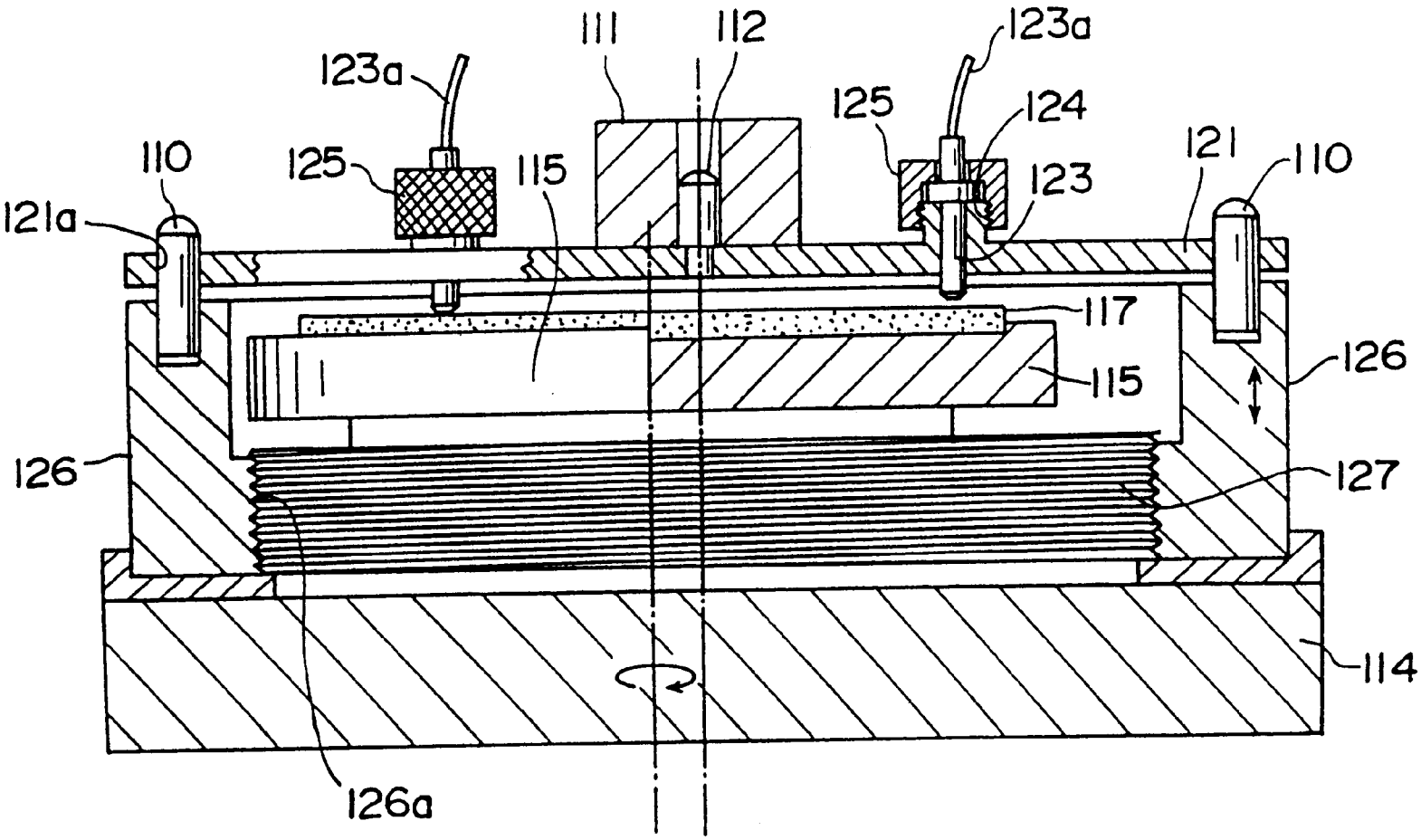
FIG. 15 PRIOR ART
FIG. 15 is a schematic view for explaining problems of the polishing apparatus disclosed in U.S. Pat. No. 5,351,445.

In the case of the polishing apparatus for optical fiber end surface, one ferrule with an optical fiber or a plurality of ferrules with optical fibers set to ferrule holding means integrated with the vertically moving plate 18 realizes or realize preferable polishing independently of height fluctuation (the fluctuation of L in FIG. 14). That is, the vertically moving plate 18 constituting a part of vertically moving means can depend on a precise fitting accuracy with four spindles 20 guided by the bearing 19 and makes it possible to perform accurate polishing by vertically pressing it so that no backlash or inclination occurs. Moreover, it is possible to set ferrule holding means integrally with a vertically moving plate upward under a preparation state under an automatic vertical motion by a motor. Therefore, it is possible to clean and replace a polishing film and a polishing board without removing a ferrule holder. Moreover, it is possible to clean the end surface of a ferrule set to ferrule holding means from the lower side without removing the ferrule holding means.

Furthermore, it is possible to set the lowering speed of the vertically moving plate 18 to a small value when pressing a ferrule to be polished against a polishing board. Thus, slow contact and grinding are realized.

It is conventionally difficult to obtain a high-quality polishing result because a ferrule to be polished is hit to a rotating polishing board so as to drop the ferrule onto the board or rotation of a stopping polishing board is started after securing the ferrule on the board and thereby, an optical fiber protruded from the end surface of the ferrule integrally with an adhesive is forcibly plucked off and resultingly, a deep flaw or crack is produced on the cross section of the optical fiber. However, an effective result is obtained by slow contact (normally referred to as soft landing) and slow grinding as described above.

It is possible to variously modify the embodiments above described in detail within the range of the present invention. In the above embodiments, an example of spherical surface polishing of a ferrule and an optical fiber is shown. However, the present invention can be also widely applied to polishing of a plane and polishing of an angled spherical surface.

What is claimed is:

1. A polishing apparatus for optical fiber end surface for polishing a ferrule end surface, comprising:

a base;

a rotary disk supporting a polishing member for forming a polishing plane and rotatably set to said base;

ferrule holding means for removably supporting one or more optical-fiber ferrule;

vertically guiding means for vertically movably supporting said ferrule holding means in parallel with said polishing plane and moving between a reference position and a polishing end position;

urging means for urging said vertically guiding means supporting said ferrule holding means in the direction vertical to said polishing plane, wherein the urging means includes a first urging means for urging said vertically guiding means supporting said ferrule holding means in the direction of said polishing plane and a second urging means comprising a spring for urging said vertically guiding means in the opposite direction of the first urging means in order to lower the guiding means to the starting state wherein the contacting force of the ferrules is almost zero;

vertically driving means for vertically driving said vertically guiding means supporting said ferrule holding means; and a control circuit for driving said vertically driving means to allow the vertical guiding means to move from a preparation state to a starting state and by compressing the second urging means to allow the guiding means to lower further beyond the starting state to complete the polishing.

2. A polishing apparatus for optical fiber end surface according to claim 1, wherein said first urging means provides the contact pressure between a ferrule in polishing and said polishing plane.

3. A polishing apparatus for optical fiber end surface according to claim 2, wherein said first urging means is a compression spring and the contact pressure between a ferrule in polishing and said polishing plane can be changed by adjusting a compression length.

4. A polishing apparatus for optical fiber and surface according to claim 1, wherein said vertically guiding means is set to said base and includes a vertically moving plate secured to a plurality of supports slidably guided by a plurality of bearings vertical to said polishing plane in the axial direction.

5. A polishing apparatus for optical fiber end surface according to claim 1, wherein said vertically driving means includes linearly driving means for vertically driving said vertically guiding means.

6. A polishing apparatus for optical fiber end surface according to claim 1, further comprising removable means for removably supporting said ferrule holding means to said vertically guiding means.

7. A polishing apparatus for optical fiber end surface according to claim 6, wherein said removable means slides by fitting to a parallel groove portion of said ferrule holding means on a U-shaped aperture provided for the vertical moving plate of said vertically guiding means.

8. A polishing apparatus for optical fiber end surface according to claim 6, wherein said removable means is constituted by bayonet-connecting said ferrule holding means to a bayonet aperture provided for the vertical moving plate of said vertically guiding means.

9. A polishing apparatus for optical fiber end surface according to claim 1, further comprising spring press-fitting means for press-fitting said vertical guiding means against the ferrule holding means at a point on the plane of the ferrule holding means, thereby allowing the said vertical guiding means to raise and lower simultaneously with the ferrule holding means, while maintaining constant press-fitting contact with the ferrule holding means.

10. A polishing apparatus for optical fiber end surface according to claim 1, further comprising securing means for engaging said ferrule holding means with said vertically guiding means and then securing said ferrule holding means to said vertically guiding means.

11. A polishing apparatus for optical fiber end surface according to claim 1, wherein said control circuit can control the lowering speed of said vertically guiding means so as to decrease the lowering speed under polishing immediately before said ferrule contacts a polishing plane.

12. A polishing apparatus for optical fiber end surface according to claim 1, wherein said control circuit can set a polishing time in accordance with the purpose of polishing.

13. A polishing apparatus for optical fiber end surface according to claim 1, wherein said control circuit can previously set a plurality of combinations between a polishing time and a contact pressure in accordance with the purpose of polishing and continuously control the combinations during one repetition of rising and lowering.

14. A polishing apparatus for optical fiber end surface according to claim 1, further comprising a vertically moving, horizontally oriented supporting plate with a bayonet aperture for supporting said removable ferrule holding means to said vertically guiding means, wherein said removable ferrule holding means is mounted onto the bayonet aperture of said vertically moving, horizontally oriented supporting plate.

15. A polishing apparatus for optical fiber end surface for polishing a ferrule end surface, comprising:

a base;

a rotary disk supporting a polishing member for forming a polishing plane and rotatably set to said base;

ferrule holding means for removably supporting one or more optical-fiber ferrule;

vertically guiding means for vertically movably supporting said ferrule holding means in parallel with said polishing plane and moving between a reference position and a polishing end position;

urging means for urging said vertically guiding means supporting said ferrule holding means in the direction vertical to said polishing plane, the urging means includes a first urging means for urging said vertically guiding means supporting said ferrule holding means in the direction of said polishing plane and a second urging means for urging said vertically guiding means in the opposite direction of the first urging means;

vertically driving means for vertically driving said vertically guiding means supporting said ferrule holding means;

a control circuit for driving said vertically driving means to allow the vertical guiding means to move from a preparation state to a starting state and by compressing the second urging means to allow the guiding means to lower further beyond the starting state to complete the polishing; and a vertically moving, horizontally oriented supporting plate with a U-shaped aperture for supporting said removable ferrule holding means to said vertically guiding means, wherein said removable ferrule holding means slides horizontally into a parallel groove portion of said vertically moving, horizontally oriented supporting plate's u-shaped aperture.

* * * * *